United States Patent [19]

Buck, Jr. et al.

[11] 4,054,256

[45] Oct. 18, 1977

[54] SUPPORT FOR A GOLF BAG

[76] Inventors: Elwood W. Buck, Jr., 3330 San Pasqual, Pasadena, Calif. 91107; Thomas M. Shiroma, 1162 Ridgeside Drive, Monterey Park, Calif. 91754; Charles E. Amos, 4613 Trujillo Ave., Covina, Calif. 91722; Yoshiharu Takenaka, 662 Ranlett Ave., La Puente, Calif. 91744

[21] Appl. No.: 715,634

[22] Filed: Aug. 18, 1976

[51] Int. Cl.[2] ..... A63B 55/00

[52] U.S. Cl. ..... 248/96; 248/166; 248/219.4; 248/291; 248/360

[58] Field of Search ..... 248/96, 150, 148, 218.4, 248/219.4, 231, 359, 360, 171, 166, 169, 291; 150/1.5 B

[56] References Cited

U.S. PATENT DOCUMENTS

| | | | |
|---|---|---|---|
| 1,810,903 | 6/1931 | Campbell | 248/96 |
| 2,007,709 | 7/1935 | Eppens | 150/1.5 B X |
| 2,064,542 | 12/1936 | Jones | 248/96 X |
| 2,324,439 | 7/1943 | Thommen | 248/96 |
| 2,959,388 | 11/1960 | Fogle | 248/231 |
| 3,432,130 | 3/1969 | Breedlove et al. | 248/96 |
| 3,647,171 | 3/1972 | Rafferty | 248/231 X |

FOREIGN PATENT DOCUMENTS

| | | | |
|---|---|---|---|
| 635,317 | 4/1950 | United Kingdom | 248/96 |
| 579,087 | 7/1946 | United Kingdom | 248/96 |

*Primary Examiner*—Roy D. Frazier
*Assistant Examiner*—Rodney H. Bonck
*Attorney, Agent, or Firm*—Poms, Smith, Lande & Glenny

[57] ABSTRACT

A support for supporting a golf bag in a position on a supporting surface wherein the golf bag is at an angle of less than 90° with respect to the supporting surface. The support is removably secured on the golf bag. When not being used, the support lays flat against an upright golf bag. When it is desired to use such support, the golf bag is lowered by pivoting the bottom end of the bag on the supporting surface, the support at the upper end of the bag swinging under gravity outwardly away from the golf bag and, in outer position, supports the golf bag on a supporting surface in inclined positin without the necessity of manually locking the support in position. When it is desired to release such support, it moves under gravity back into position against the golf bag as the bag is raised without the necessity of manually releasing the support.

9 Claims, 6 Drawing Figures

SUPPORT FOR A GOLF BAG

BACKGROUND OF THE INVENTION

1. Field of the Invention

The invention relates to golf bag supports; and more particularly, to a support for quickly and easily supporting a golf bag in a desired inclined position with respect to a supporting surface, such as the ground.

2. Description of the Prior Art

Various arrangements have been suggested over the years for supporting a golf bag at a desired angular orientation with respect to a supporting surface. In the U.S. Pat. No. 1,757,471 to Platt, an automatic foldable stand for a golf bag is disclosed. The stand requires braces and a metal plate at the bottom to support the stand and is quite complicated to use. U.S. Pat. No. 2,324,439 to Thommen shows a simpler support but requires a spring clip to fasten the support to the bag and a chain to keep the support legs from pivoting too far. Such an arrangement is less steady than desirable since the bag must support the weight of a plurality of golf clubs.

A U.S. Pat. No. 2,571,088 to Walton shows a support requiring a bracket on the bag with a releasable bail portion slidable in the bracket to lock the support in place. A U.S. Pat. No. 3,758,061 to Townhill shows various modifications of stands for golf bags, all of which require clips or the like to hold the legs in place.

Thus, no prior art reference shows a support for a golf bag which provides the rigidity necessary to hold the bag, with a load of golf clubs, in a convenient angular orientation, can withstand extended use and falls under gravity and without mechanical or manual assistance, into either bag supporting position or a stored position against the bag.

SUMMARY OF INVENTION

It is an object of this invention to provide a stable support for a golf bag which support automatically positions a golf bag in an inclined relationship to the ground with lateral stability.

It is another object of this invention to provide such a support which is adapted to assume a flat position against the bag when the bag is upright and to extend away from the bag, be gravity forces, when the bag is taken from a shoulder carry position and lowered to the ground.

It is still another object of this invention to carry out the foregoing objects without the use of complicated braces, chains or the like for bracing and imparting stability to such a support.

It is still another object of this invention to provide such a golf bag support which supports the bag in a stable manner, is reliable in operation, is capable of withstanding abuse and rough usage on the golf course, is readily assembled and attached to a golf bag, is readily removable from the bag if desired for transport and shipment of the bag, and does not interfere with or cause discomfort to a player when the bag is carried by the shoulder strap.

A still further object of this invention is to provide a golf bag support which is readily manufactured, easy to assemble, and is inexpensive.

These and other objects are preferably accomplished by providing a golf bag support which is removably secured to the golf bag and assumes its several positions essentially by the forces of gravity. When it is desired to use such a golf bag support, the support swings under gravity outwardly away from the golf bag as the golf bag is lowered to the ground and in this position supports the golf bag on the ground or a supporting surface without any further action by the player and without the necessity of manually locking it in position. When it is desired to raise the golf bag to the shoulder of the player, the golf bag support falls under gravity into position adjacent the bag and in a generally vertical position.

Various other objects and advantages of the present invention will be readily apparent from the following description of the drawings in which an exemplary embodiment of the invention is shown.

DESCRIPTION OF THE PREFERRED EMBODIMENT

Figure 1:
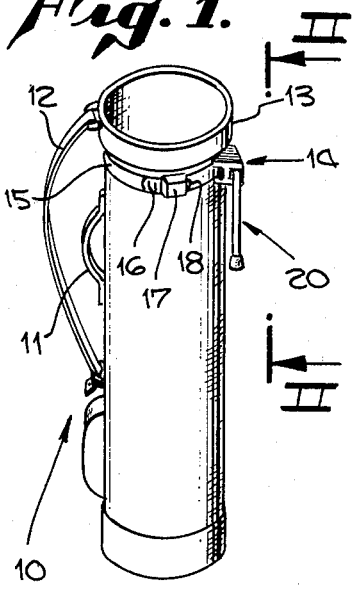
FIG. 1 is a perspective view of a conventional bag in upright position having a golf bag support in accordance with this invention.

Referring now to FIG. 1 of the drawings, a conventional golf bag 10 is shown having a carrying handle 11, a shoulder strap 12, and an open top for receiving a plurality of golf clubs and related golf paraphernalia therein. Generally, such bags have reinforcing collars 13, such as of leather or the like, at the top and bottom ends of the bag, but the teachings of my invention are not dependent on the bag having such reinforcing collars.

As particularly contemplated in the present invention, a golf bag support 14 is provided which may be removably attached to golf bag 10. Attachment is readily accomplished by providing an adjustable metal band 15 encircling the outer periphery of bag 10 at or below reinforcing collar 13. Band 15 may include well-known metal band clamp constructions having apertures or slots 16 in the band, the end of which is insertable in a locking member 17 which includes a threaded bolt 18. Bolt 18 may be turned to selectively engage slots 16 within member 17 for tightening or loosening of the band 15 about the bag and to thereby removably attach band 15 and support 14 to bag 10.

Figure 2:
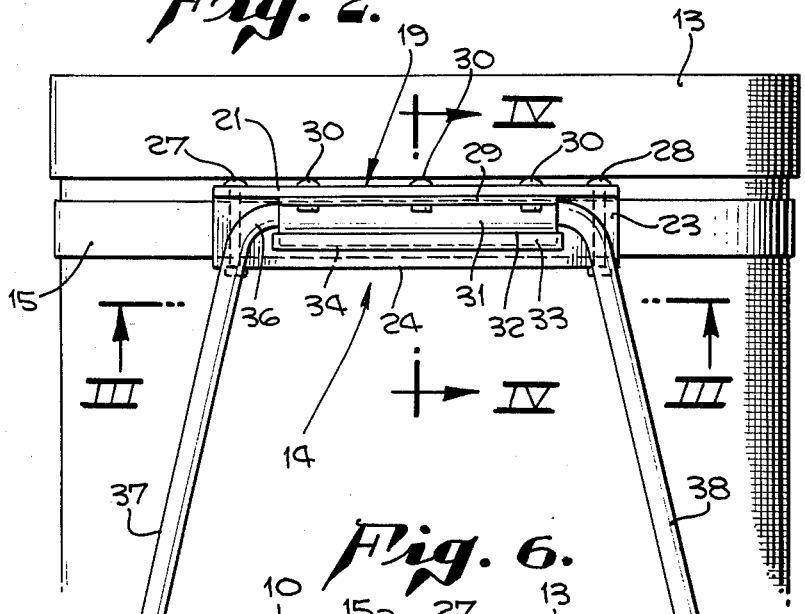
FIG. 2 is an enlarged fragmentary side view taken from the plane indicated by line II—II of FIG. 1.
Figure 3:
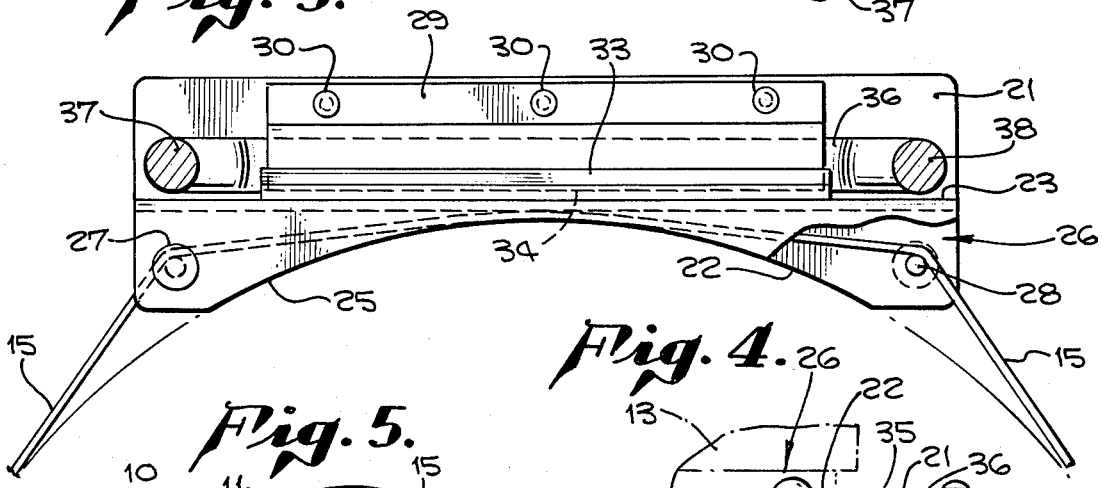
FIG. 3 is a fragmentary bottom view of the golf bag support taken from the plane indicated by line III—III of FIG. 2.
Figure 4:
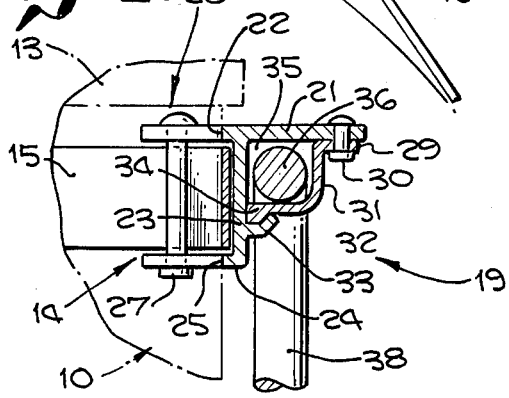
FIG. 4 is a fragmentary sectional view taken in the vertical plane indicated by line IV—IV of FIG. 2.
Figure 5:
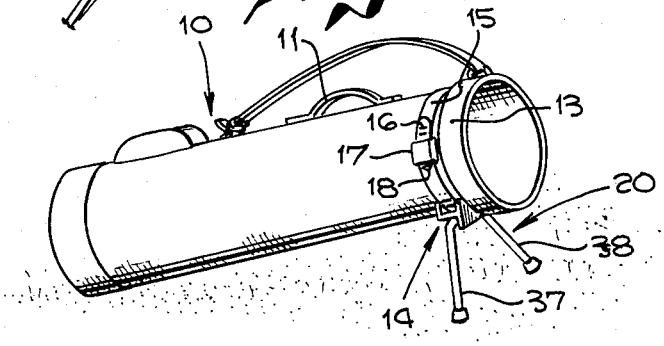
FIG. 5 is a perspective view of the golf bag and support of FIG. 1 showing the support in operative position supporting the inclined golf bag on the ground or supporting surface.

Referring now to FIG. 2, support 14 includes a bracket or flange means 19 adapted to receive band 15 thereon and leg support 20 pivotally mounted to flange means 19 for supporting bag 10 in the inclined position shown in FIG. 5. Flange means 19 includes a first portion in the form of a generally rectangular top plate 21 (see also FIG. 4) which plate 21 includes an arcuate cutout portion 22 along one edge margin (see also FIG. 3) configured substantially the same as the outer surface of the generally cylindrical golf bag 10 to generally fit thereagainst.

Flange means 19 also includes a second portion in the form of a second plate 23 generally rectangular in configuration and extending downwardly at right angles from substantially the midportion of first plate 21 (see FIG. 4). A third plate 24 extends from the lower edge of second plate 23 and is in spaced parallel relation to first plate 21. An arcuate cutout portion 25 (see FIG. 3) is provided in plate 24, similar to configuration of cutout portion 22 and aligned therewith. As shown in FIGS. 1, 4 and 5, cutout portions 22, 25 receive and at least partially conform to outer surface portions of golf bag 10. The spaced contact of cutout portions 22, 25 with the bag surface substantially avoids the rocking of the flange means 19 relative to the bag.

Flange means 19 also includes band receiving means 26 for receiving band 15 therein for securing means 19 to bag 10. Such band receiving means 26 includes one or more cylindrical pin members extending between and secured to stop plate 21 and bottom plate 24 adjacent ends of cutout portions 22, 25 and spaced from second plate 23. Pin member 27, 28 and plates 21, 23, 24 provide and open passage way for threading or passing band 15 therethrough. Tightening band 15 at locking member 17 contracts the band 15 around bag 10 and secures support 14 to the bag in a rigid immovable manner.

Flange means 19 further includes means for pivotally loosely mounting leg support 20 to flange means 19. Such mounting means include a flanged angle section member having a flange portion 29 (FIG. 4) fixedly secured against the underside of top plate 21 by suitable rivets 30 or the like. An angle leg portion 31 extends downwardly generally normal to flange portion 29 and an angle leg portion 32 extends inwardly parallel to flange portion 29 to form with plates 21 and 23 a square shaped through passageway 35. An angle section upwardly opening retaining rib 33 extends parallel to plate 21 and is integral therewith. Retaining rib 33 receives and interlocks with an enlarged beaded edge 34 on the angle leg portion 32 and is configured to correspond with the surfaces on rib 33 and plate 23 defining the upwardly facing opening of retaining rib. In assembly of angle section member 31, 32 with the retaining rib, it will be apparent that the beaded edge 34 may be positioned in the retaining rib 33 and the angle section member then pivoted upwardly for connection of the flange portion 29 with the top plate 21 of the flange means. Interlocking of the beaded edge 34 with the retaining rib 33 extends for a major portion of the length of plate 23 and serves to provide a metal section of additional strength to resist impact forces against the flange means 19 when the bag is lowered to the ground as later described. Through passageway 35 loosely receives and mounts leg support 20 therein.

Referring now to FIG. 2, leg support 20 may be of bail-like shape and includes a transverse portion 36 positioned within passageway 35 and interconnecting at its ends a pair of spaced elongated legs 37, 38. Each leg 37, 38 may be set at an angle slightly greater than 90° with respect to transverse portion 36 for imparting lateral stability to the leg support. The ends of legs 37, 38 may be provided with cushioning member **37*a*, 38*a***, respectively to resist penetration of the ground surface when the bag is lowered to the ground.

When the bag 10 is in upright position as shown in FIG. 1 and the support 14 is attached to the upper end of the bag, it will be apparent that the leg support 20 hangs vertically downwardly and lies in a generally flat position against the bag.

When bag 10 is carried by the shoulder strap 12, the bag 10 may assume a number of upwardly inclined positions depending upon the desire of the player carrying the bag. In other words, the angular position of the bag being carried may vary between almost vertical, such as 15° to 20° from the vertical to almost horizontal; such as 15° to 20° from the horizontal. Since leg support 20 is freely pivotally mounted on the flange means 19, the legs 37, 38 will normally assume a vertical position at such varied carrying position of the bag. It is important to note that the length of legs 37, 38 are relatively short, an example being about 10 inches long. Transverse member 36 may have an exemplary length of about 4 inches to 5 inches. Since larger diameter golf bags approximate 10 inches, it will be apparent that even with the divergence of the legs 37, 38 that the leg support 20 will not exceed the space occupied by the bag to a degree sufficient to cause interference with the player or discomfort to the player. On smaller diameter bags, a smaller dimensioned leg support 14 may be used; however, it is intended that one size golf bag support 14 be provided which will accommodate both small and large diameter bags. Very small diameter bags should preferably be equipped with a smaller dimensioned golf bag support 14.

When the golf player stops at the position of his ball and lowers the bag to the ground, it should be noted that the bottom end of the bag rests on the ground; and as the bag is lowered, it is pivoted about the bottom end of the bag. The leg support 20 swings away from the bag because of gravitational forces. The player imparts a slight forward motion to the lowering of the bag so that the forward motion will be imparted to the legs 37, 38 so that when the bag reaches its final inclined position with the ends **37*a* and 38*a* of the legs positioned on the ground the upper portion of the legs adjacent the transverse member 36 will be in abutment as at 40 with the inner surface of plate 21 (FIG. 6) such abutment of the upper portion of legs 37, 38 with plate 21 limits the forward swinging of the legs and places the legs 37, 38 forwardly of a vertical plane passing through the axis of the transverse portion 36 or of the passageway 35. The weight of the upper end portion of the bag causes the transverse portion 36 to bear against the plate 23 as at 41 and to also bear as at 42 against the angle section member adjacent the interlocking of the enlarged beaded edge 34 and the retainer rib 33. It will be understood that when a full complement of golf clubs are carried in a bag, that is about 14 clubs, a substantial load and impact force is imparted to the golf bag support 14 when the bag is lowered to the ground, since such lowering may not often be done in a gentle manner. The forward inclined disposition of legs 37, 38 is desired to be held to a minimum because of the impact loads which place considerable stress at the bearing or abutment areas 40 and 42**, such forward inclination being necessary to prevent forward collapse of the support and falling of the top end of the bag to the ground.

Figure 6:
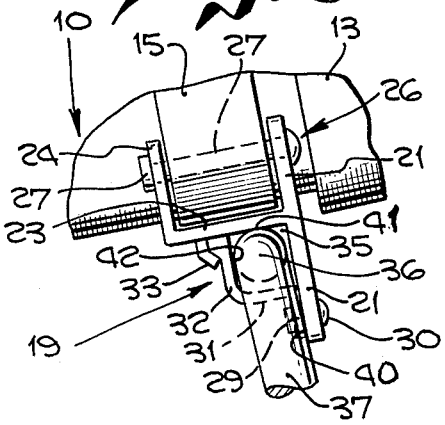
FIG. 6 is an enlarged fragmentary side view of the support positioned as shown in FIG. 5.

From the position of the leg support 20 shown in FIG. 6, it will be apparent that the flange portion 29 of the angle section member provides additional metal section for support of the outer longitudinal edge margin of the plate 21 and that if desired the flanged portion 29 may be extended for the full length of plate 21.

The golf bag support 14 provides a stable support for the bag 10 both in the longitudinal direction of the bag and laterally of the bag. Longitudinal stability is provided by the forward inclination of the legs 37, 38 and the abutment of the legs against the plate 21, together with the manner in which the transverse portion 36 is confined within the passageway. Lateral stability is provided by the divergence of legs 37, 38.

When the golf player lifts the bag, he may do so by either the shoulder strap or the handle 11. In either case, the strap or handle is conveniently reached because of the additional height which the support 14 has given to the upper portion of the bag. Upon further lifting of the bag, the legs 37, 38 which are now disengaged from the ground, are generally vertically disposed because of the gravitational forces.

The golf bag support 14 is made of relatively few parts, the flange means preferably being an extrusion of a lightweight aluminum alloy and cut to a preselected length. The flanged angle section member may also be an extrusion cut to a selected length for assembly with the plate 21. The assembly of the flanged angle section member with the plate 21 is facilitated by the rib and bead interlock 33, 34 and by the riveting to plate 21 at a readily accessible location.

Golf bag support 14 is virtually automatically activated by gravity when the bag is lowered to the ground in a natural lowering movement by the player. Support 14 holds the top end of the bag in spaced relation to the ground and therefore serves to protect the golf bag and golf clubs from contact with the ground except where the bottom end of the bag touches the ground at a support point. The swinging movement of leg support 20 is trouble free.

All changes and modifications which come within the scope of the appended claims are embraced thereby.

We claim:

1. A support for supporting a golf bag having an open top in a fixed position at an angle of less than 90° to a supporting surface comprising:

flange means fixedly secured to said bag at a position adjacent to the open top thereof; said flange means including spaced parallel flange portions having configured edges to seat against said bag, a base flange portion interconnecting said parallel flange portions, and spaced pins interconnecting said spaced flange portions in spaced relation to said base flange portion, a stop flange portion extending in the direction opposite to said spaced parallel flange portions, a leg support receiving means secured to said stop flange portion and said base flange portion and defining an open ended space;

and a support means having at least two support legs interconnected by a transverse member receivable within said open ended space, said legs having a supporting first position with said legs in abutment with said stop flange portion to support said bag, said legs having other positions generally alongside said bag and in angular relationship thereto as determined by gravity.

2. A support for supporting a golf bag having a generally cylindrical configuration with a cylindrical body portion and closed at the bottom by a bottom wall and open at the top for receiving golf clubs or the like in the interior thereof, the support which comprises:

a supporting flange;

a pair of abutting flanges fixedly secured on opposite sides of said supporting flange extending in a direction generally normal to the plane of said supporting flange, both of said abutting flanges extending in the same direction and for approximately the same distance from said supporting flange, each of said abutting flanges being arcuately shaped along the edges thereof extending parallel to the plane of said supporting flange and remote from said supporting flange in a manner substantially configured to the outer cylindrical configuration of said golf bag;

a first member secured to one of said abutting flanges at a point spaced from said supporting flange and extending generally normal to the plane of said abutting flanges and fixed to the other oppositely disposed abutting flange;

a second member secured to said one of said abutting flanges at a point spaced from said supporting flange and extending generally normal to the plane of said abutting flanges and fixed to said other oppositely disposed abutting flange;

a stop plate fixedly secured to said supporting flange extending generally normal to said supporting flange and in a direction opposite said abutting flanges;

a leg support receiving plate secured to said supporting flange and said stop plate having a first portion extending in a direction generally normal from said supporting flange, a second portion integral with the first portion extending in a direction generally normal from said first portion to said stop plate and extending generally parallel to the plane of said supporting flange and abutting against said stop plate, thereby providing a space between said first and second portions of said receiving plate, said supporting flange and said stop plate; and a generally U-shaped leg support having a pair of legs interconnected by a transverse member which is pivotally secured in the space formed between said first and second portions of said receiving plate, said supporting flange and said stop plate whereby said leg support is freely pivotable within said space between a first position having said legs abutting against said stop plate with said legs extending in a direction having a plane generally parallel to the plane of said stop plate and a second position with said legs abutting against said supporting flange with said legs extending in a direction having a plane generally parallel to the plane of said supporting flange.

3. In the support of claim 2 wherein each of said legs are at an angle slightly greater than 90° with respect to said transverse member.

4. In the support of claim 3 wherein cushioning members are provided on the terminal ends of each of said legs.

5. In the support of claim 2 wherein said supporting flange, said abutting flanges and said stop plate are formed from one integral piece of rigid material.

6. In the support of claim 5 wherein said supporting flange is generally rectangular and said stop plate is integral with one of said abutting flanges and co-planar thereto.

7. In the support of claim 6 wherein said first and second members are generally cylindrical pins.

8. An article of manufacture comprising:

a first single piece of metallic material having a first generally rectangular flat plate having an arcuate cut-out along one elongated edge thereof, a second generally rectangular flat plate of substantially the same length as said first plate extending at an angle normal to said first plate from substantially the middle thereof, and a third flat plate of substantially the same length as said first plate extending at an angle normal to said second plate and generally parallel to said first plate and only in the same direction as said arcuate cutout portion and having an arcuate cutout portion configured substantially the same as said first-mentioned arcuate cutout portion and generally in the same vertical plane as said first-mentioned arcuate cutout portion;

a first elongated member interconnecting said first plate to said third plate adjacent said cut-out portions, a second elongated member spaced from the first elongated member interconnecting said first plate to said third plate adjacent said cutout portions;

a second single piece of metallic material fixedly secured to said first piece of metallic material on the side thereof opposite said cutout portions, said second piece having a first portion extending generally normal to said first plate, a second portion on said second piece extending generally normal to said first portion of said second piece, the second portion extending to said second plate; and a generally U-shaped pivotable member having a generally elongated bail portion interconnecting a pair of elongated members, said bail portion being freely pivotable within a space formed between said second piece and said first piece and retained therein, said elongated members extending away from said first and second pieces of metallic material.

9. In the article of manufacture of claim 8 wherein each of said pair of elongated members are at an angle slightly greater than 90° with respect to said bail portion.

* * * * *